US011636963B2

(12) United States Patent
Saito et al.

(10) Patent No.: US 11,636,963 B2
(45) Date of Patent: Apr. 25, 2023

(54) METHOD FOR MANUFACTURING POWDER MAGNETIC CORE

(71) Applicants: SUMITOMO ELECTRIC INDUSTRIES, LTD., Osaka (JP); SUMITOMO ELECTRIC SINTERED ALLOY, LTD., Takahashi (JP)

(72) Inventors: Tatsuya Saito, Osaka (JP); Hijiri Tsuruta, Takahashi (JP); Tomoyuki Ueno, Osaka (JP)

(73) Assignees: SUMITOMO ELECTRIC INDUSTRIES, LTD., Osaka (JP); SUMITOMO ELECTRIC SINTERED ALLOY, LTD., Takahashi (JP)

( * ) Notice: Subject to any disclaimer, the term of this patent is extended or adjusted under 35 U.S.C. 154(b) by 14 days.

(21) Appl. No.: 17/256,759

(22) PCT Filed: Jun. 18, 2019

(86) PCT No.: PCT/JP2019/024139
§ 371 (c)(1),
(2) Date: Dec. 29, 2020

(87) PCT Pub. No.: WO2020/008866
PCT Pub. Date: Jan. 9, 2020

(65) Prior Publication Data

US 2021/0249167 A1 Aug. 12, 2021

(30) Foreign Application Priority Data

Jul. 4, 2018 (JP) ..... JP2018-127889

(51) Int. Cl.
*H01F 1/22* (2006.01)
*B22F 3/24* (2006.01)

(52) U.S. Cl.
CPC ..... *H01F 1/22* (2013.01); *B22F 3/24* (2013.01); *B22F 2003/248* (2013.01)

(58) Field of Classification Search
None
See application file for complete search history.

(56) References Cited

U.S. PATENT DOCUMENTS

2011/0204744 A1* 8/2011 Tsu ..... H02K 1/24 310/216.066
2015/0061188 A1 3/2015 Hasegawa et al.
(Continued)

FOREIGN PATENT DOCUMENTS

CN 107808729 A 3/2018
JP S6111282 B2 * 4/1986
(Continued)

OTHER PUBLICATIONS

Machine translation of JPS61-11282B2. (Year: 1986).*

*Primary Examiner* — Xiaowei Su
(74) *Attorney, Agent, or Firm* — Faegre Drinker Biddle & Reath LLP

(57) ABSTRACT

A method for manufacturing a powder magnetic core, including a step of compacting a raw material powder to form a compact, a step of performing a first heat treatment on the compact to obtain a first heat-treated body, and a step of performing a second heat treatment on the first heat-treated body to obtain a second heat-treated body, wherein the raw material powder contains a soft magnetic powder and a lubricant that has a melting point Tm, the first heat treatment is performed in a temperature range from Tm to Tm+50° C. inclusive for a time longer than 10 minutes, and the second heat treatment is performed in a temperature range from 400° C. to 900° C. inclusive for a time of 3 minutes to 90 minutes inclusive, the temperature range of
(Continued)

the second heat treatment being higher than the temperature range of the first heat treatment.

7 Claims, 1 Drawing Sheet

(56) References Cited

U.S. PATENT DOCUMENTS

| | | | | |
|---|---|---|---|---|
| 2015/0118511 | A1 | 4/2015 | Hasegawa et al. | |
| 2018/0068770 | A1 | 3/2018 | Kawarai et al. | |
| 2018/0079006 | A1* | 3/2018 | Igarashi | H01F 1/24 |

FOREIGN PATENT DOCUMENTS

| | | | |
|---|---|---|---|
| JP | 2012-186255 | A | 9/2012 |
| JP | 2013-098384 | A | 5/2013 |
| WO | WO-2013/154146 | A1 | 10/2013 |
| WO | WO-2013/161747 | A1 | 10/2013 |
| WO | WO-2016/158336 | A1 | 10/2016 |

* cited by examiner

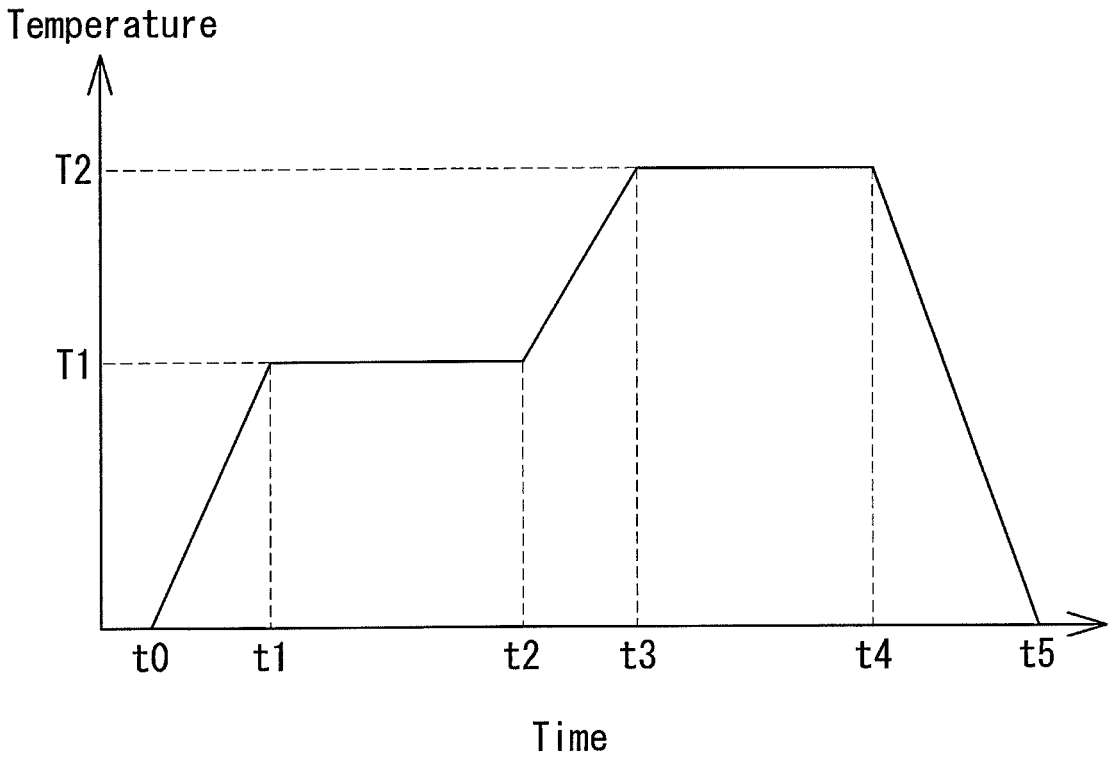
Temperature
T2
T1
t0
t1
t2
t3
t4
t5
Time

METHOD FOR MANUFACTURING POWDER MAGNETIC CORE

TECHNICAL FIELD

The present disclosure relates to a method for manufacturing a powder magnetic core.

The present application claims the benefit of priority based on Japanese Patent Application No. 2018-127889 filed on Jul. 4, 2018, which is incorporated herein by reference in its entirety.

BACKGROUND ART

Patent Document 1 discloses a method for heat-treating a compact that includes a step of forming a compact by compacting a soft magnetic powder together with a lubricant and a step of heat-treating the compact. In this method for heat-treating a compact, heat treatment is performed in two steps, that is, a first heat treatment and a second heat treatment. In the first heat treatment, the compact is heated at a temperature within a decomposition temperature range in which the lubricant decomposes and evaporates. In the second heat treatment, the compact is heated at a distortion removing temperature that is higher than the decomposition temperature range after the first heat treatment. The first heat treatment is performed to suppress adhesion of a residue that is formed through carbonization of the lubricant to a surface of the heat-treated compact.

CITATION LIST

Patent Documents

Patent Document 1: WO 2016/158336

SUMMARY OF INVENTION

A method for manufacturing a powder magnetic core according to the present disclosure includes:

a step of compacting a raw material powder to form a compact;

a step of performing a first heat treatment on the compact to obtain a first heat-treated body; and a step of performing a second heat treatment on the first heat-treated body to obtain a second heat-treated body, wherein the raw material powder contains a soft magnetic powder and a lubricant that has a melting point Tm, the first heat treatment is performed in a temperature range from Tm to Tm+50° C. inclusive for a time longer than 10 minutes, and the second heat treatment is performed in a temperature range from 400° C. to 900° C. inclusive for a time of 3 minutes to 90 minutes inclusive, the temperature range of the second heat treatment being higher than the temperature range of the first heat treatment.

A method for manufacturing a powder magnetic core according to the present disclosure includes:

a step of compacting a raw material powder to form a compact;

a step of performing a first heat treatment on the compact to obtain a first heat-treated body; and a step of performing a second heat treatment on the first heat-treated body to obtain a second heat-treated body, wherein the raw material powder contains a soft magnetic powder and a lubricant that has a melting point Tm of 80° C. to 230° C. inclusive, the soft magnetic powder has a mean particle diameter D50 of 220 μm or less, the first heat treatment is performed in a temperature range from Tm to Tm+50° C. inclusive for a time longer than 10 minutes, and the second heat treatment is performed in a temperature range from 400° C. to 900° C. inclusive for a time of 3 minutes to 90 minutes inclusive, the temperature range of the second heat treatment being higher than the temperature range of the first heat treatment.

BRIEF DESCRIPTION OF DRAWINGS

FIG. 1 is a graph of a heat treatment temperature in a method for manufacturing a powder magnetic core according to an embodiment.

DESCRIPTION OF EMBODIMENTS

Problem to be Solved by the Present Disclosure

A compact that is formed by compacting a soft magnetic powder together with a lubricant contains air between soft magnetic particles constituting the soft magnetic powder, and between soft magnetic particles and the lubricant. Accordingly, if the temperature of the compact containing the soft magnetic powder and the lubricant is linearly increased to a relatively high temperature, the air contained in the compact may suddenly expand and cause a surface of the compact to bulge. This may deteriorate the flatness of the heat-treated body (powder magnetic core) obtained through heat treatment.

Therefore, it is an object of the present disclosure to provide a method for manufacturing a powder magnetic core with which it is possible to obtain a powder magnetic core that is excellent in terms of flatness.

Advantageous Effects of the Present Disclosure

The method for manufacturing a powder magnetic core according to the present disclosure makes it possible to obtain a powder magnetic core that is excellent in terms of flatness.

DESCRIPTION OF EMBODIMENTS OF THE PRESENT DISCLOSURE

First, details of an embodiment of the present disclosure will be listed and described.

(1) A method for manufacturing a powder magnetic core according to an embodiment of the present disclosure includes:

a step of compacting a raw material powder to form a compact;

a step of performing a first heat treatment on the compact to obtain a first heat-treated body; and a step of performing a second heat treatment on the first heat-treated body to obtain a second heat-treated body, wherein the raw material powder contains a soft magnetic powder and a lubricant that has a melting point Tm, the first heat treatment is performed in a temperature range from Tm to Tm+50° C. inclusive for a time longer than 10 minutes, and the second heat treatment is performed in a temperature range from 400° C. to 900° C. inclusive for a time of 3 minutes to 90 minutes inclusive, the temperature range of the second heat treatment being higher than the temperature range of the first heat treatment.

In the method for manufacturing a powder magnetic core, the raw material powder obtained by mixing the lubricant with the soft magnetic powder is used. This is for suppressing friction that occurs between the compact and a mold during compacting and keeping soft magnetic particles constituting the soft magnetic powder from strongly rubbing against each other. The compact formed by compacting the raw material powder containing the soft magnetic powder and the lubricant contains air. In the method for manufacturing a powder magnetic core according to the present disclosure, air contained in the compact can be removed to the outside as a result of the first heat treatment being performed on the compact. The first heat treatment is performed in the temperature range from the melting point Tm of the lubricant to Tm+50° C. inclusive. Therefore, the lubricant can be molten through the first heat treatment, and the molten lubricant can be removed to the outside of the compact along soft magnetic particles, whereby air flow channels can be formed through which the inside and the outside of the compact are in communication. Note that the temperature of the first heat treatment is not higher than Tm+50° C. and is not extremely high, and accordingly, sudden expansion of air contained in the compact can be suppressed. Furthermore, Tm+50° C. is usually lower than a temperature at which the lubricant decomposes, and accordingly, the generation of a gas due to the lubricant decomposing can also be suppressed.

The second heat treatment is performed to remove distortion introduced into the compact. Accordingly, the temperature range of the second heat treatment is higher than the temperature range of the first heat treatment. The second heat treatment is performed on the compact (first heat-treated body) obtained through the first heat treatment. Accordingly, the second heat treatment can be performed in a state in which only a small amount of air is contained in the compact or substantially no air is contained in the compact. Therefore, even if the second heat treatment is performed in a relatively high temperature range in which distortion is removed, bulging of the surface of the compact (second heat-treated body) can be suppressed. This is because sudden expansion of air can be suppressed even if air remaining within the first heat-treated body expands. As described above, in the method for manufacturing a powder magnetic core according to the present disclosure, the first heat treatment is performed in the temperature range in which the lubricant melts, and thereafter the second heat treatment is performed in the relatively high temperature range in which distortion can be removed, and therefore distortion introduced into the compact can be removed and a powder magnetic core that is excellent in terms of flatness can be obtained.

(2) In the method for manufacturing a powder magnetic core according to the embodiment, it is possible that the soft magnetic powder has a mean particle diameter D50 of 220 μm or less.

If the mean particle diameter of the soft magnetic powder is 220 μm or less, an eddy current loss of the soft magnetic powder is likely to be reduced and a powder magnetic core having a smaller loss can be obtained. However, if the mean particle diameter of the soft magnetic powder is 220 μm or less, the strength of the compact is likely to be low when compared to a case in which the mean particle diameter is large. If the strength of the compact is low, when air contained in the compact suddenly expands, the compact may not be able to endure the internal pressure of the air and is likely to rupture. In the method for manufacturing a powder magnetic core according to the present disclosure, air contained in the compact is removed to the outside through the first heat treatment, and thereafter distortion is removed through the second heat treatment, as described above. Therefore, in the method for manufacturing a powder magnetic core according to the present disclosure, even if air remaining within the compact (first heat-treated body) expands, expansion pressure of the air is small, and it is possible to suppress rupturing of the compact (first heat-treated body) and bulging of a surface of the compact. For this reason, in the case of the powder magnetic core according to the present disclosure, even if the strength of the compact is low, distortion introduced into the compact can be removed and a powder magnetic core that is excellent in terms of flatness can be obtained.

(3) In the method for manufacturing a powder magnetic core according to the embodiment, it is possible that the melting point Tm of the lubricant is 80° C. to 230° C. inclusive.

If the melting point Tm of the lubricant is at least 80° C., functions of the lubricant can be maintained even if the temperature of the mold is increased through friction that occurs between the mold and the compact in continuous molding. On the other hand, if the melting point Tm of the lubricant is not higher than 230° C., the lubricant can be molten even if a heat treatment temperature of the first heat treatment is not extremely high.

(4) In the method for manufacturing a powder magnetic core according to the embodiment, it is possible that an amount of the lubricant contained in the raw material powder is 0.1 mass % or more and less than 1.0 mass %.

If the amount of the lubricant is 0.1 mass % or more, friction that occurs between the compact and the mold during compacting is likely to be reduced, and soft magnetic particles constituting the soft magnetic powder are likely to be kept from strongly rubbing against each other. On the other hand, if the amount of the lubricant is less than 1.0 mass %, the lubricant can be easily removed to the outside of the compact through the first heat treatment, and a state in which only a small amount of the lubricant remains within the compact or the lubricant does not substantially remain within the compact is likely to be achieved.

(5) In the method for manufacturing a powder magnetic core according to the embodiment, it is possible that the compact has a relative density lower than 97%.

If the relative density of the compact is lower than 97%, spaces are likely to be formed between soft magnetic particles when the lubricant is removed to the outside of the compact through the first heat treatment, and air flow channels are likely to be formed through which the inside and the outside of the compact are in communication.

(6) In the method for manufacturing a powder magnetic core according to the embodiment, it is possible that the first heat treatment is performed in a non-oxidizing atmosphere.

If the first heat treatment is performed in a non-oxidizing atmosphere, formation of an oxide film on the surface of the compact can be prevented and air contained in the compact can be easily removed to the outside.

(7) In the method for manufacturing a powder magnetic core according to the embodiment, it is possible that the compacting is performed in a state in which a mold is heated to a temperature of Tm−100° C. to Tm−20° C. inclusive.

If the mold is heated to a temperature of at least Tm−100° C., friction that occurs between the compact and the mold is likely to be reduced as a result of the lubricant contained in the compact becoming soft. On the other hand, if the mold is heated to a temperature not higher than Tm−20° C., the lubricant can be kept from melting during compacting and can maintain its functions.

(8) A method for manufacturing a powder magnetic core according to an embodiment of the present disclosure includes:

a step of compacting a raw material powder to form a compact;

a step of performing a first heat treatment on the compact to obtain a first heat-treated body; and a step of performing a second heat treatment on the first heat-treated body to obtain a second heat-treated body, wherein the raw material powder contains a soft magnetic powder and a lubricant that has a melting point Tm of 80° C. to 230° C. inclusive, the soft magnetic powder has a mean particle diameter D50 of 220 μm or less, the first heat treatment is performed in a temperature range from Tm to Tm+50° C. inclusive for a time longer than 10 minutes, and the second heat treatment is performed in a temperature range from 400° C. to 900° C. inclusive for a time of 3 minutes to 90 minutes inclusive, the temperature range of the second heat treatment being higher than the temperature range of the first heat treatment.

The method for manufacturing a powder magnetic core described in item (8) has the same effects as the method for manufacturing a powder magnetic core described in item (1) to item (3).

DETAILS OF EMBODIMENTS OF THE PRESENT DISCLOSURE

The following describes specific examples of a method for manufacturing a powder magnetic core according an embodiment of the present disclosure. The present invention is defined by the terms of the claims, but not limited to the above description, and is intended to include any modifications within the meaning and scope equivalent to the terms of the claims.

Method for Manufacturing Powder Magnetic Core

The method for manufacturing a powder magnetic core according to the embodiment includes a molding step of forming a compact by compacting a raw material powder that contains a soft magnetic powder and a lubricant and a heat treatment step of heat-treating the compact. One of the characteristics of the method for manufacturing a powder magnetic core according to the embodiment is that the heat treatment step includes a first heat treatment step of performing heat treatment in a temperature range in which the lubricant melts and a second heat treatment step of performing heat treatment in a temperature range in which distortion can be removed. The second heat treatment step is performed after the first heat treatment step. Details of each step will be described below.

Molding Step

The molding step is a step of forming a compact by compacting a raw material powder that contains a soft magnetic powder and a lubricant. Specifically, the raw material powder is placed into a mold and is compacted using a press apparatus. The following first describes the raw material powder and thereafter describes conditions for compacting.

Soft Magnetic Powder

The soft magnetic powder is constituted by an aggregate of soft magnetic particles. The soft magnetic particles may contain iron in an amount of at least 50 mass %, for example. Specifically, the soft magnetic particles are made of pure iron or an iron-based alloy. Pure iron referred to herein has purity of at least 99%, that is, contains iron (Fe) in an amount of at least 99 mass %. If the compact is made of pure iron, compactibility is good and a powder magnetic core that has high magnetic permeability and high magnetic flux density can be obtained. The iron-based alloy referred to herein contains additive elements and the remaining portion of the iron-based alloy is constituted by Fe and inevitable impurities. The iron-based alloy contains one or more additive elements. Examples of additive elements include silicon (Si) and aluminum (Al). Specific examples of the iron-based alloy include Fe—Si-based alloys, Fe—Al-based alloys, Fe—N-based alloys, Fe—Ni-based alloys, Fe—C-based alloys, Fe—B-based alloys, Fe—Co-based alloys, Fe—P-based alloys, Fe—Ni—Co-based alloys, and Fe—Al—Si-based alloys. If the compact is made of the iron-based alloy, an eddy current loss is likely to be reduced and a powder magnetic core that has a smaller loss can be obtained.

The soft magnetic powder may have a mean particle diameter of 220 μm or less, for example. If the mean particle diameter of the soft magnetic powder is 220 μm or less, an eddy current loss of the soft magnetic powder is likely to be reduced and a powder magnetic core that has a smaller loss can be obtained. However, if the mean particle diameter of the soft magnetic powder is 220 μm or less, the strength of the compact is likely to be low. If the strength of the compact is low, when air contained in the compact suddenly expands, the compact may not be able to endure the internal pressure of the air and rupture. In the method for manufacturing a powder magnetic core according to the present embodiment, at least a portion of air contained in the compact can be removed to the outside as a result of a first heat treatment, which will be described later, being performed. Therefore, even if air remaining in the compact expands, expansion pressure of the air is small, and it is possible to suppress rupturing of the compact and bulging of a surface of the compact even if the strength of the compact is low. On the other hand, the mean particle diameter of the soft magnetic powder may be at least 10 μm, for example. If the mean particle diameter of the soft magnetic powder is at least 10 μm, the soft magnetic powder is easy to handle and a powder magnetic core that has a small hysteresis loss can be obtained. The mean particle diameter of the soft magnetic powder may be preferably 10 μm to 220 μm inclusive, more preferably 20 μm to 180 μm inclusive, and particularly preferably 30 μm to 120 μm inclusive. The mean particle diameter of the soft magnetic powder is a particle diameter (D50 particle size) at which accumulation from a small particle size side reaches 50% in a particle size distribution on the volume basis that is found using a commercially available laser diffraction particle size distribution measurement device.

Each soft magnetic particle constituting the soft magnetic powder may include an insulating covering on its surface. If the insulating covering is provided on surfaces of the soft magnetic particles, the eddy current loss of the soft magnetic powder is likely to be reduced and a powder magnetic core that has a smaller loss can be obtained. The insulating covering can be constituted by a metal oxide, a metal nitride, a metal carbide, or the like such as an oxide, a nitride, or a carbide that contains one or more metal elements. Examples of metal elements include iron (Fe), aluminum (Al), calcium (Ca), manganese (Mn), zinc (Zn), magnesium (Mg), vanadium (V), chromium (Cr), yttrium (Y), barium (Ba), strontium (Sr), and rare earth elements (excluding Y). Alternatively, the insulating covering may also be constituted by one or more compounds selected from phosphorus compounds, silicon compounds (such as a silicone resin), zirconium compounds, and aluminum compounds. Other than these, the insulating covering may also be constituted by a metal salt compound such as a metal phosphate compound (typically, iron phosphate, manganese phosphate, zinc phosphate, calcium phosphate, or the like), a metal borate compound, a metal silicate compound, or a metal titanate compound.

The thickness of the insulating covering may be 10 nm to 1 μm inclusive, for example. If the thickness of the insulating covering is at least 10 nm, insulation between soft magnetic particles can be easily ensured. On the other hand, if the thickness of the insulating covering is not larger than 1 μm, it is possible to suppress a reduction in the amount of the soft magnetic powder contained in the powder magnetic core due to the presence of the insulating covering.

Lubricant

The lubricant may be a solid lubricant that is constituted by a lubricant powder, for example. A solid lubricant is in a solid state at normal temperature (temperature (20° C.±15° C.) defined in JIS Z 8703). If the lubricant is a solid lubricant, the lubricant can be easily mixed with the soft magnetic powder. The lubricant may be, for example, a lubricant that can be easily uniformly mixed with the soft magnetic powder, can sufficiently deform between soft magnetic particles constituting the soft magnetic powder when the compact is compacted, and can be molten through the first heat treatment described later to be removed to the outside of the compact.

The melting point Tm of the lubricant may be 80° C. to 230° C. inclusive, for example. If the melting point Tm of the lubricant is at least 80° C., functions of the lubricant can be maintained even if the temperature of the mold is increased through friction that occurs between the mold and the compact in continuous molding. On the other hand, if the melting point Tm of the lubricant is not higher than 230° C., a heating temperature that is applied to melt the lubricant can be lowered to some extent, and accordingly, it is possible to melt the lubricant without setting a heat treatment temperature of the first heat treatment described later to an extremely high temperature. Furthermore, if the melting point Tm of the lubricant is not higher than 230° C., energy required for heating can be reduced. Examples of the lubricant include higher fatty acid amides such as lauric acid amide, palmitic acid amide, stearic acid amide, and ethylenebis stearic acid amide and metallic soap such as zinc stearate, lithium stearate, and calcium stearate.

The amount of the lubricant contained in the raw material powder may be 0.1 mass % or more and less than 1.0 mass %, for example. Here, the amount of the lubricant refers to a total amount of the lubricant when the amount of the raw material powder is taken to be 100 mass %. If the amount of the lubricant is at least 0.1 mass %, friction that occurs between the compact and the mold during compacting is likely to be reduced, and soft magnetic particles constituting the soft magnetic powder are likely to be kept from strongly rubbing against each other. The larger the amount of the lubricant is, the less likely it is that air contained in the obtained compact is removed to the outside, and the more likely it is that the surface of the compact bulges when the air contained in the compact suddenly expands. In the method for manufacturing a powder magnetic core according to the present embodiment, at least a portion of air contained in the compact can be removed to the outside as a result of the first heat treatment described later being performed. If the amount of the lubricant is less than 1.0 mass %, the lubricant can be easily removed to the outside of the compact through the first heat treatment described later, and a state in which only a small amount of the lubricant remains within the compact or the lubricant does not substantially remain within the compact is likely to be achieved. If the amount of the lubricant remaining within the compact is small, a dense powder magnetic core that has excellent magnetic characteristics can be obtained. The amount of the lubricant contained in the raw material powder may be preferably 0.15 mass % to 0.80 mass % inclusive, and particularly preferably 0.20 mass % to 0.60 mass % inclusive.

If the lubricant is a solid lubricant constituted by a lubricant powder, a mean particle diameter (D50 particle size) of the lubricant powder may be 1 μm to 40 μm inclusive, for example. If the mean particle diameter of the lubricant powder is at least 1 μm, friction that occurs between the compact and the mold during compacting is likely to be reduced, and soft magnetic particles constituting the soft magnetic powder are likely to be kept from strongly rubbing against each other. On the other hand, if the mean particle diameter of the lubricant powder is not larger than 40 μm, the lubricant powder can be easily mixed with the soft magnetic powder and can be easily removed to the outside of the compact through the first heat treatment described later. The mean particle diameter of the lubricant powder may be preferably 2 μm to 35 μm inclusive, and particularly preferably 3 μm to 30 μm inclusive.

A double cone mixer or a V mixer is preferably used to mix the soft magnetic powder and the lubricant.

Compacting

A compacting pressure applied in compacting may be 500 MPa to 2000 MPa inclusive. If the compacting pressure is at least 500 MPa, the soft magnetic powder can be sufficiently compressed and a relative density of the compact can be increased. On the other hand, if the compacting pressure is not higher than 2000 MPa, the relative density of the compact is such that spaces are likely to be formed between soft magnetic particles when the lubricant is removed. The compacting pressure may be preferably 600 MPa to 1800 MPa inclusive, and particularly preferably 700 MPa to 1500 MPa inclusive. If compacting is performed with this compacting pressure, it is possible to obtain a compact having a relative density of 85% or more and less than 97%, preferably 88% to 96% inclusive, and particularly preferably 90% to 95% inclusive. The "relative density" refers to an actual density relative to a true density (a percentage value of [actually measured density of the compact]/[true density of the compact]). The true density is a density that can be calculated from the composition of the soft magnetic powder contained in the compact.

Compacting may be performed in a state in which the mold is heated to a temperature of Tm−100° C. to Tm−20° C. inclusive. If the mold is heated to a temperature of at least Tm−100° C., friction that occurs between the compact and the mold is likely to be reduced as a result of the lubricant contained in the compact becoming soft. On the other hand, if the mold is heated to a temperature not higher than Tm−20° C., the lubricant can be kept from melting during compacting and can maintain functions.

Heat Treatment Step

In the heat treatment step, heat treatment is performed in two steps, that is, a first heat treatment step and a second heat treatment step. In the first heat treatment step, a first heat-treated body is formed by heating the compact in a temperature range in which the lubricant contained in the compact melts. In the second heat treatment step, a second heat-treated body (powder magnetic core) is formed by heating the first heat-treated body in a temperature range in which distortion introduced into the compact can be removed. FIG. 1 shows transition of the heat treatment temperature in the two-step heat treatment. In FIG. 1, the horizontal axis indicates time and the vertical axis indicates the heat treatment temperature.

First Heat Treatment Step

The first heat treatment step is a step of performing the first heat treatment on the compact obtained through the molding step, in a temperature range from Tm to Tm+50° C. inclusive for a time longer than 10 minutes to obtain the first heat-treated body. Tm represents the melting point of the lubricant. The first heat treatment is performed to remove the lubricant contained in the compact to the outside of the compact by melting the lubricant, and remove air contained in the compact to the outside by forming air flow channels through which the inside and the outside of the compact are in communication.

A first heat treatment temperature (T1 in FIG. 1) is in the temperature range from Tm to Tm+50° C. inclusive. If the first heat treatment temperature is at least Tm, it is possible to melt the lubricant, remove the molten lubricant to the outside of the compact along soft magnetic particles, and form air flow channels through which the inside and the outside of the compact are in communication. On the other hand, if the first heat treatment temperature is not higher than Tm+50° C., sudden expansion of air contained in the compact can be suppressed since the first heat treatment temperature is not extremely high. Furthermore, Tm+50° C. is usually lower than a temperature at which the lubricant decomposes, and accordingly, the generation of a gas due to the lubricant decomposing can be suppressed.

In the first heat treatment, it is only necessary to perform heat treatment in the above-described range of the first heat treatment temperature, and the heat treatment temperature may be kept constant or may be changed during a first heat treatment time (from t1 to t2 in FIG. 1). For example, the first heat treatment includes cases in which the heat treatment is performed while increasing the heat treatment temperature or reducing the heat treatment temperature or increasing and reducing the heat treatment temperature within the range of the first heat treatment temperature during the first heat treatment time. In a case in which the temperature is changed during the first heat treatment, the temperature may be increased at a heating rate of less than 5° C./minute, preferably 4° C./minute or less, and particularly preferably 3° C./minute or less.

The first heat treatment time (from t1 to t2 in FIG. 1) is longer than 10 minutes. If the first heat treatment time is longer than 10 minutes, it is possible to melt the lubricant, remove the molten lubricant to the outside of the compact along soft magnetic particles, and form air flow channels through which the inside and the outside of the compact are in communication. The longer the first heat treatment time is, the more sufficiently the lubricant can be molten, and therefore the first heat treatment time may be preferably at least 15 minutes, and particularly preferably at least 20 minutes. On the other hand, if the first heat treatment time is not longer than 120 minutes, an increase in the heat treatment time can be suppressed and the first heat treatment step can be efficiently performed. The first heat treatment time may be preferably longer than 10 minutes and no longer than 120 minutes, more preferably 15 minutes to 90 minutes inclusive, and particularly preferably 20 minutes to 60 minutes inclusive.

The melting point Tm of the lubricant varies according to the type of the lubricant. Therefore, a preliminary test is carried out using a compact containing the lubricant to find a temperature range in which the lubricant melts and a time for which the compact needs to be kept in the temperature range to remove the lubricant to the outside of the compact. The first heat treatment is performed on the compact based on the test results. For example, if the lubricant is made of stearic acid amide as described later in test examples, the first heat treatment temperature may be 99° C. to 149° C. inclusive, and the first heat treatment time may be longer than 10 minutes and no longer than 120 minutes. If the lubricant is made of ethylenebis stearic acid amide, the first heat treatment temperature may be 147° C. to 197° C. inclusive, and the first heat treatment time may be longer than 10 minutes and no longer than 120 minutes.

The first heat treatment may be performed in a non-oxidizing atmosphere. If the first heat treatment is performed in a non-oxidizing atmosphere, formation of an oxide film on the surface of the compact can be prevented and air contained in the compact can be easily removed to the outside. The oxygen concentration in the non-oxidizing atmosphere may be 10000 ppm or less on the volume basis.

A heating rate during a time (from t0 to t1 in FIG. 1) from when heating of the compact is started to when the temperature reaches the range of the first heat treatment temperature may be at least 5° C./minute. If the heating rate is at least 5° C./minute, the compact can be quickly heated and productivity can be enhanced. Time (t1) at which the temperature reaches the range of the first heat treatment temperature varies according to the heating rate. The heating rate may be preferably at least 10° C./minute.

Second Heat Treatment Step

The second heat treatment step is a step of performing a second heat treatment on the first heat-treated body obtained through the first heat treatment step, in a temperature range from 400° C. to 900° C. inclusive for a time of 3 minutes to 90 minutes inclusive to obtain the second heat-treated body. Distortion introduced into the first heat-treated body (compact) can be removed by performing the second heat treatment. As a result of distortion being removed from the compact, a powder magnetic core that has a low hysteresis loss can be obtained.

A second heat treatment temperature (T2 in FIG. 1) is in the temperature range from 400° C. to 900° C. inclusive. The second heat treatment temperature is in a temperature range in which distortion introduced into the first heat-treated body (compact) is removed. Accordingly, the second heat treatment temperature is higher than the first heat treatment temperature. The second heat treatment temperature and a time (from t3 to t4 in FIG. 1) for which the second heat treatment temperature is maintained vary according to the type of the soft magnetic powder. Therefore, a temperature and a time with which distortion can be removed are found in advance according to the type of the soft magnetic powder, and the second heat treatment is performed based on the found temperature and time. If the second heat treatment temperature is within the above-described range, distortion introduced into the compact can be removed regardless of the type of the soft magnetic powder. The second heat treatment temperature may be preferably 450° C. to 850° C. inclusive, 450° C. to 800° C. inclusive, 450° C. to 750° C. inclusive, and particularly preferably 500° C. to 700° C. inclusive. The time for which the second heat treatment temperature is maintained may be 3 minutes to 90 minutes inclusive, preferably 4 minutes to 60 minutes inclusive, and particularly preferably 5 minutes to 30 minutes inclusive. There is no specific limitation on the atmosphere in which the second heat treatment is performed.

A heating rate during a time (from t2 to t3 in FIG. 1) from the end of the first heat treatment to when the temperature reaches a temperature at which distortion can be removed in the second heat treatment may be at least 5° C./minute. If the heating rate is at least 5° C./minute, the first heat-treated body (compact) can be quickly heated and productivity can be enhanced.

Time (t3) at which the temperature reaches a temperature at which distortion can be removed varies according to the heating rate. The heating rate may be preferably at least 10° C./minute.

A cooling rate at which the second heat-treated body (powder magnetic core) is cooled after the end of the second heat treatment (t4 in FIG. 1) can be appropriately selected. The cooling rate may be at least 2° C./minute, and preferably at least 10° C./minute, for example. The second heat-treated body may be cooled through air cooling.

Other Heat Treatment Step

In the heat treatment step, a third heat treatment step may also be performed between the first heat treatment step and the second heat treatment step. In the third heat treatment step, a third heat treatment is performed in a decomposition temperature range in which the lubricant removed to the outside of the compact through the first heat treatment decomposes or evaporates. A third heat treatment temperature is higher than the first heat treatment temperature and is lower than the second heat treatment temperature. If the temperature of the first heat-treated body obtained through the first heat treatment step is linearly increased to the temperature range in which distortion can be removed, the lubricant may be carbonized on the surface of the first heat-treated body (compact) before disappearing through decomposition or evaporation. A carbonized material of the lubricant adheres to the outer surface of the second heat-treated body (powder magnetic core) obtained through the second heat treatment step and surfaces forming holes inside the second heat-treated body. Therefore, the third heat treatment is performed between the first heat treatment step and the second heat treatment step to decompose or evaporate the lubricant. Owing to the third heat treatment, it is possible to perform heat treatment in the temperature range in which distortion can be removed, after the lubricant removed to the surface of the first heat-treated body (compact) has disappeared through decomposition or evaporation. Accordingly, it is possible to suppress adhesion of a residue to the surface of the obtained second heat-treated body (powder magnetic core).

The decomposition temperature range of the lubricant varies according to the type of the lubricant. Therefore, a preliminary test is carried out using a compact containing the lubricant to find a temperature range in which the lubricant decomposes or evaporates and a time for which the compact needs to be kept in the temperature range to decompose or evaporate the lubricant. Based on the test results, heat treatment is performed on the first heat-treated body (compact) in the above-described decomposition temperature range. For example, if the lubricant is made of stearic acid amide, the decomposition temperature range may be from 171° C. to 265° C. inclusive and a time for which the compact is kept in the decomposition temperature range may be 30 minutes to 120 minutes inclusive. If the lubricant is made of ethylenebis stearic acid amide, the decomposition temperature range may be from 216° C. to 390° C. inclusive and a time for which the compact is kept in the decomposition temperature range may be 30 minutes to 120 minutes inclusive.

Effects

In the above-described method for manufacturing a powder magnetic core, the first heat treatment is performed in a temperature range in which the lubricant melts, and thereafter the second heat treatment is performed in a relatively high temperature range in which distortion can be removed. Therefore, even if air contained in the compact expands during heat treatment, expansion pressure of the air is small, and rupturing of the compact and bulging of the surface of the compact can be suppressed. Accordingly, the second heat-treated body (powder magnetic core) obtained through the above-described method for manufacturing a powder magnetic core only has small distortion or does not substantially have distortion, and the flatness of the second heat-treated body (powder magnetic core) is excellent.

Powder Magnetic Core

A powder magnetic core obtained through the above-described method for manufacturing a powder magnetic core is constituted by a compact formed by compacting the soft magnetic powder, and the flatness of a surface of the powder magnetic core may be 0.03 mm or less, for example. The "flatness" refers to a size of deviation from a geometrically exact flat surface of a planar form (JIS B 0621 (1984)). Flatness can be calculated using a method in which maximum deflection flatness is used. Maximum deflection flatness is a method of setting planes passing through three points that are apart from each other as far as possible in a target plane and calculating the maximum value of deviation as the flatness. If the flatness of the powder magnetic core is 0.03 mm or less, it is possible to configure a part using a powder magnetic core that is faithful to design. The flatness of the powder magnetic core may be preferably 0.02 mm or less, more preferably 0.015 mm or less, and particularly preferably 0.01 mm or less.

Test Examples

Powder magnetic cores were manufactured using raw material powders containing soft magnetic powders and lubricants and the flatness of the powder magnetic cores was checked.

First, raw material powders each obtained by mixing a soft magnetic powder having a D50 particle size shown in Table 1 and a lubricant shown in Table 1 were prepared. The soft magnetic powder was made of pure iron, and each soft magnetic particle constituting the soft magnetic powder included an insulating covering having a thickness of 0.1 μm on its surface. The lubricant was made of stearic acid amide (shown as SA in Table 1) or ethylenebis stearic acid amide (shown as EBS in Table 1). The amount of the lubricant is an amount of the lubricant relative to the whole amount of the raw material powder on the mass basis. Each of the prepared raw material powders was placed into a mold and compacted in a state in which the mold was heated to 60° C. to form a compact having a size of 30 mm×30 mm×20 mm. The compacting pressure applied in compacting was appropriately selected such that the obtained compact had a relative density shown in Table 1.

Next, in each of samples No. 1-1 to 1-11 and 1-21 to 1-25, a first heat treatment was performed on the obtained compact by keeping the compact at a temperature shown in Table 1 for a time shown in Table 1 in a non-oxidizing atmosphere (oxygen concentration was not higher than 10000 ppm on the volume basis) to obtain a first heat-treated body. At this time, the compact was heated from normal temperature to the first heat treatment temperature at a heating rate of 5° C./minute. In samples No. 1-26 to 1-28, the first heat treatment was not performed on the obtained compact.

Lastly, in a non-oxidizing atmosphere (oxygen concentration was not higher than 1000 ppm on the volume basis), a second heat treatment was performed at 600° C. for 15 minutes on the obtained first heat-treated body in the case of the samples No. 1-1 to 1-11 and 1-21 to 1-25 or the obtained compact in the case of the samples No. 1-26 to 1-28, to manufacture a powder magnetic core. At this time, the first heat-treated body was heated from the first heat treatment temperature to the second heat treatment temperature at a heating rate of 5° C./minute. After the second heat treatment has ended, the powder magnetic core was cooled to the room temperature through natural cooling.

Flatness was measured for each of the obtained powder magnetic cores of the samples. First, in a state in which four corner points of a surface with a size of 30 mm×30 mm of the powder magnetic core were adjusted to the same height, heights of 5×5=25 points were measured using a height gauge in a plane with a size of 20 mm×20 mm that was inward of edges by 5 mm. A sum of squares of distances between the group of 25 points and a plane was calculated, and a plane for which the sum of squares was the smallest was taken to be an approximate plane. Then, the largest value of distances between the 25 points and the approximate plane was found and taken to be the flatness. Measurement results are shown in Table 1.

TABLE 1

| Sample No. | Soft magnetic powder D50 (μm) | Lubricant Type | Lubricant Melting point (° C.) | Lubricant Amount (mass %) | Compact Relative density (%) | First heat treatment Temperature (° C.) | First heat treatment Time (min) | Powder magnetic core Flatness (mm) |
|---|---|---|---|---|---|---|---|---|
| 1-1 | 58 | EBS | 147 | 0.40 | 92.9 | 160 | 90 | 0.0097 |
| 1-2 | 58 | EBS | 147 | 0.10 | 92.9 | 160 | 90 | 0.0068 |
| 1-3 | 58 | EBS | 147 | 0.40 | 92.9 | 160 | 15 | 0.0100 |
| 1-4 | 58 | EBS | 147 | 0.40 | 92.9 | 150 | 15 | 0.0163 |
| 1-5 | 58 | EBS | 147 | 0.40 | 92.9 | 180 | 15 | 0.0130 |
| 1-6 | 58 | EBS | 147 | 0.80 | 92.9 | 160 | 90 | 0.0173 |
| 1-7 | 58 | SA | 99 | 0.40 | 92.9 | 130 | 15 | 0.0146 |
| 1-8 | 58 | EBS | 147 | 0.40 | 95 | 150 | 15 | 0.0192 |
| 1-9 | 152 | EBS | 147 | 0.40 | 95 | 150 | 15 | 0.0143 |
| 1-10 | 58 | EBS | 147 | 0.40 | 97 | 150 | 90 | 0.0251 |
| 1-11 | 58 | EBS | 147 | 1.00 | 92.9 | 160 | 90 | 0.0286 |
| 1-21 | 58 | EBS | 147 | 0.40 | 92.9 | 160 | 10 | 0.0655 |
| 1-22 | 58 | EBS | 147 | 0.40 | 92.9 | 140 | 90 | 0.0759 |
| 1-23 | 58 | SA | 99 | 0.40 | 92.9 | 90 | 90 | 0.0635 |
| 1-24 | 58 | EBS | 147 | 0.40 | 92.9 | 200 | 15 | 0.0535 |
| 1-25 | 58 | SA | 99 | 0.40 | 92.9 | 150 | 15 | 0.0323 |
| 1-26 | 58 | EBS | 147 | 0.40 | 92.9 | — | — | 0.1033 |
| 1-27 | 58 | EBS | 147 | 0.10 | 92.9 | — | — | 0.0406 |
| 1-28 | 152 | EBS | 147 | 0.40 | 95 | — | — | 0.0232 |

From the results shown in Table 1, it was found that the flatness of the powder magnetic core was not larger than 0.03 mm and was excellent in each of the samples No. 1-1 to 1-11 in which the first heat treatment was performed on the compact in a temperature range from the melting point Tm of the lubricant to Tm+50° C. inclusive for a time longer than 10 minutes, and then heat treatment was performed at a temperature at which distortion can be removed. This is presumably because the lubricant was molten as a result of the first heat treatment being performed on the compact at a specific temperature for a specific time, and air flow channels through which the inside and the outside of the compact were in communication were formed as a result of the molten lubricant being removed to the outside of the compact along soft magnetic particles. If air flow channels are formed, air contained in the compact is removed to the outside via the flow channels. It is thought that for this reason, sudden expansion of air was suppressed and a surface of the compact was kept from bulging even when the compact (first heat-treated body) was heated in a temperature range in which distortion could be removed.

In particular, it was found that the flatness of the powder magnetic core was not larger than 0.02 mm and was more excellent in each of the samples No. 1-1 to 1-9 in which the amount of the lubricant contained in the compact was less than 1.0 mass % and the relative density of the compact was lower than 97%. This is presumably because, if the amount of the lubricant is small, the lubricant can be easily removed to the outside of the compact through the first heat treatment. Also, it is thought that if the relative density of the compact is low, spaces are likely to be formed between soft magnetic particles in a state in which the lubricant has been removed to the outside of the compact, and air can be easily removed to the outside of the compact. It was found that the flatness of the powder magnetic core was not larger than 0.01 mm and was extremely excellent in each of the samples No. 1-1 and 1-2 in which the amount of the lubricant contained in the compact was relatively small and the first heat treatment time was long. This is presumably because a major portion of the lubricant contained in the compact was removed to the outside of the compact through the first heat treatment and a state in which the lubricant did not substantially remain within the compact was achieved.

On the other hand, it was found that the flatness of the powder magnetic core was inferior in each of the samples No. 1-26 to 1-28 in which heat treatment was performed at a high temperature at which distortion could be removed, without the first heat treatment being performed. This is presumably because air contained in the compact suddenly expanded as a result of the first heat treatment being not performed and heat treatment being performed at the high temperature at which distortion could be removed in a state in which air was contained in the compact. Note that the flatness of the powder magnetic core was better in the sample No. 1-28, when compared to the other samples No. 1-26 and 1-27 in which the first heat treatment was not performed. This is presumably because the mean particle diameter of the soft magnetic powder contained in the compact was relatively large, and accordingly, the strength of the compact was higher than that in the samples No. 1-26 and 1-27 and the compact could endure an internal pressure when air contained in the compact expanded.

Also, it was found that the flatness of the powder magnetic core was inferior in each of the samples No. 1-22 and 1-23 in which the heat treatment temperature of the first heat treatment was low and in the sample No. 1-21 in which the heat treatment time was short. This is presumably because the lubricant could not be sufficiently removed to the outside of the compact through the first heat treatment, and a large amount of the lubricant remained within the compact. On the other hand, it was found that the flatness of the powder magnetic core was inferior in each of the samples No. 1-24 and 1-25 in which the heat treatment temperature of the first heat treatment was high. This is presumably because air contained in the compact expanded at the heat treatment temperature of the first heat treatment in a process of removing the lubricant to the outside of the compact.

The invention claimed is:

1. A method for manufacturing a powder magnetic core, comprising:

a step of compacting a raw material powder to form a compact;

a step of performing a first heat treatment on the compact to obtain a first heat-treated body, wherein prior to performing the first heat treatment the compact has a relative density of 85% or more and 95% or less; and a step of performing a second heat treatment on the first heat-treated body to obtain a second heat-treated body, wherein the raw material powder contains a soft magnetic powder and a lubricant that has a melting point Tm, the first heat treatment is performed in a temperature range from Tm to Tm+50° C. inclusive for a time of 15 minutes or longer, the second heat treatment is performed in a temperature range from 400° C. to 900° C. inclusive for a time of 3 minutes to 90 minutes inclusive, the temperature range of the second heat treatment being higher than the temperature range of the first heat treatment.

2. The method for manufacturing a powder magnetic core according to claim 1, wherein the soft magnetic powder has a mean particle diameter D50 of 220 μm or less.

3. The method for manufacturing a powder magnetic core according to claim 1, wherein the melting point Tm of the lubricant is 80° C. to 230° C. inclusive.

4. The method for manufacturing a powder magnetic core according to claim 1, wherein an amount of the lubricant contained in the raw material powder is 0.1 mass % or more and less than 1.0 mass %.

5. The method for manufacturing a powder magnetic core according to claim 1, wherein the first heat treatment is performed in a non-oxidizing atmosphere.

6. The method for manufacturing a powder magnetic core according to claim 1, wherein the step of compacting is performed in a state in which a mold is heated to a temperature of Tm−100° C. to Tm−20° C. inclusive.

7. A method for manufacturing a powder magnetic core, comprising:

a step of compacting a raw material powder to form a compact;

a step of performing a first heat treatment on the compact to obtain a first heat-treated body, wherein prior to performing the first heat treatment the compact has a relative density of 85% or more and 95% or less; and a step of performing a second heat treatment on the first heat-treated body to obtain a second heat-treated body, wherein the raw material powder contains a soft magnetic powder and a lubricant that has a melting point Tm of 80° C. to 230° C. inclusive, the soft magnetic powder has a mean particle diameter D50 of 220 μm or less, the first heat treatment is performed in a temperature range from Tm to Tm+50° C. inclusive for a time of 15 minutes or longer, the second heat treatment is performed in a temperature range from 400° C. to 900° C. inclusive for a time of 3 minutes to 90 minutes inclusive, the temperature range of the second heat treatment being higher than the temperature range of the first heat treatment.

* * * * *